US005147151A

United States Patent [19]

Hipkins, Jr.

[11] Patent Number: 5,147,151

[45] Date of Patent: Sep. 15, 1992

[54] WASHER INSERT FOR BEARING PLATE

[76] Inventor: Edward C. Hipkins, Jr., 49 Escalon Dr., Coraopolis, Pa. 15108

[21] Appl. No.: 748,971

[22] Filed: Aug. 23, 1991

[51] Int. Cl.[5] ..... E21D 20/02

[52] U.S. Cl. ..... 405/259.1; 405/259.5; 411/338; 411/537

[58] Field of Search ..... 405/259, 260; 411/338, 411/339, 537, 538, 546

[56] References Cited

U.S. PATENT DOCUMENTS

| | | | |
|---|---|---|---|
| 2,386,729 | 10/1945 | Watter | 411/338 |
| 2,836,214 | 5/1958 | Rapata | 41/75 |
| 3,090,203 | 5/1963 | Durget | 405/259 |
| 3,161,174 | 12/1964 | Harrison | 405/259 X |
| 3,606,357 | 9/1971 | Yonkers | 411/537 X |
| 3,693,359 | 9/1972 | Karara . | |
| 3,835,615 | 9/1974 | King, Jr. | 52/758 |
| 3,899,893 | 8/1975 | Banerjee et al. . | |
| 4,247,224 | 1/1981 | Killmeyer | 405/260 |
| 4,275,975 | 6/1981 | Morgan | 405/261 |
| 4,285,103 | 8/1981 | Inamoto | 411/508 |
| 4,347,020 | 8/1982 | White et al. | 405/260 |
| 4,413,767 | 11/1983 | Hellinger | 411/546 X |
| 4,496,261 | 1/1985 | Cohen et al. | 405/320 |
| 4,655,645 | 4/1987 | Hipkins, Sr. et al. | 405/261 |
| 4,746,248 | 5/1988 | Lillis et al. | 405/259 X |
| 4,798,501 | 1/1989 | Spies | 405/260 |
| 4,836,729 | 6/1989 | Bisping et al. | 405/260 X |
| 4,850,746 | 7/1989 | Finsterwalder et al. | 405/260 |
| 4,878,792 | 11/1989 | Frano | 411/339 |
| 4,934,887 | 6/1990 | Sharp et al. | 411/339 |
| 4,975,008 | 12/1990 | Wagner | 411/337 |
| 4,978,265 | 12/1990 | De Wan | 411/60 |

*Primary Examiner*—Dennis L. Taylor

*Attorney, Agent, or Firm*—Webb, Burden, Ziesenheim & Webb

[57] ABSTRACT

A washer insert is made preferably of plastic for use with a bearing plate and a mine roof bolt. The bearing plate includes an upper surface, lower surface and a hole passing therethrough. The roof bolt includes a shaft having a head attached to the shaft. The outer diameter of the head is greater than the outer diameter of the shaft. The washer insert includes a hollow first section having a first end and an inner diameter equal to or greater than the outer diameter of the roof bolt shaft and less than the outer diameter of the roof bolt head. A flange attaches to the first end of the first section extending outwardly from the first section and coaxial with the first section. The flange has an upper surface and a lower surface whereby the first section is adapted to be received within the bearing plate hole so that the upper surface of the flange abuts against the lower surface of the bearing plate, the bolt shaft passes through the first section and the flange is sandwiched between the bolt head and the bearing plate.

13 Claims, 2 Drawing Sheets

WASHER INSERT FOR BEARING PLATE

BACKGROUND OF THE INVENTION

1. Field of the Invention

This invention relates to mine roof bolts and, more particularly, to a mine roof bolt which is positioned in a bore hole drilled in a rock formation in a mine roof.

2. Description of the Prior Art

It is a well established practice in underground mining work, such as coal mining, tunnel excavation, or the like, to reinforce or support the mine roof 1 of the mine to prevent rock-falls or cave-ins. The most common means presently used to support a mine roof is an elongated bolt 2 or bar that is inserted into the rock formation above the mine roof in a bore hole 3 and securely fixed within the bore hole by an anchoring device 4, such as a mechanical anchor, a quick-setting resin which surrounds the end of the bolt within the hole, or both. The roof bolt, is then placed under tension and is used to hold a metal support plate or bearing plate 5 in close engagement with the roof. See for example, U.S. Pat. No. 4,655,645.

The bore holes should be drilled perpendicular to the mine roof surface. See FIG. 1*a*. This minimizes bending of the bolt during installation, as well as minimizing the bending stress on the bolt. However, in practice, especially in inclined or uneven mine roof surfaces, the bore holes can be skewed with respect to the mine roof surface or the mine roof surface simply is not planar in the area of the bore hole. See FIG. 1*b*. This can cause bending of the bolt or abrasion of the bolt as it rubs against the perimeter of the bearing plate hole during installation, which results in high bending stresses or other forms of weakening on the bolt near the bolt head 6. In addition, excessive boom pressures from the hydraulic roof bolter equipment can place undue forces on the bolt head, particularly with an uneven roof. Typically, the boom exerts forces of between 3,000–6,000 pounds on the bolt head. In some cases, the bolt head snaps off the bolt shaft. Further, this skewed arrangement causes large amounts of friction between the rotating bolt head and the bearing plate resulting in an inefficient system with respect to the torque/tension relationship of the bolt. This is true even with a friction reducing washer 7.

It is an object of my invention to provide a mine roof bolt assembly that can compensate for a nonplanar or uneven mine roof or a bore hole not being perpendicular with the mine roof surface to provide adequate tensioning of the bolt system. It is further an object to provide an assembly which includes a member which functions as a low friction washer.

SUMMARY OF THE INVENTION

I have invented a washer insert for use with a bearing plate and mine roof bolt. The bearing plate includes an upper surface, lower surface and a hole passing therethrough. The bolt includes a shaft with the head attached to the shaft. The outer diameter of the bolt head is greater than the outer diameter of the shaft. The washer insert includes a hollow first section having a first end and an inner diameter equal to or greater than the outer diameter of the roof bolt shaft to permit passage of the roof bolt shaft therethrough. The inner diameter is less than the outer diameter of the bolt head. A flange attaches to the first end of the first section extending outwardly from the first section and coaxial with the first section. The flange has an upper surface and a lower surface whereby the first section is adapted to be received within the bearing plate hole so that the upper surface of the flange abuts against the lower surface of the bearing plate, the bolt shaft passes through the hollow portion of the first section and the flange is sandwiched between the bolt head and the bearing plate.

The first section can be in the shape of a hollow cylinder and the flange can be circular shaped. The first section height can be approximately equal to the bearing plate thickness. Further, the flange can be approximately 25% the thickness of the bearing plate. Preferably, the insert is made of plastic, such as nylon or polypropylene. The mine roof bolt can have a device for attaching or anchoring the mine roof bolt to a mine roof.

Further, the insert, bearing plate and bolt arrangement can be used in a mine roof support system.

DESCRIPTION OF THE PREFERRED EMBODIMENT

Figure 1B:
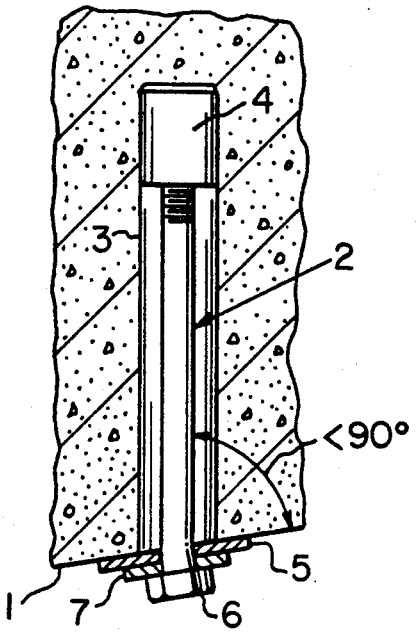
Fig. 1b PRIOR ART
FIG. 1*b* is a side elevational view, partially in section, showing a rock formation having a bore hole which is skewed with respect to the mine roof surface with a prior art roof bolt assembly in place.
Figure 1A:
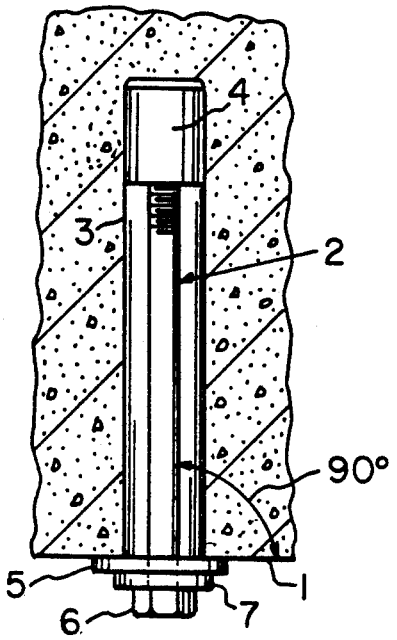
Fig. 1a PRIOR ART
FIG. 1*a* is a side elevational view, partially in section, showing a rock formation having a bore hole perpendicular to the mine roof surface with a prior art roof bolt assembly in place.
Figure 2A:
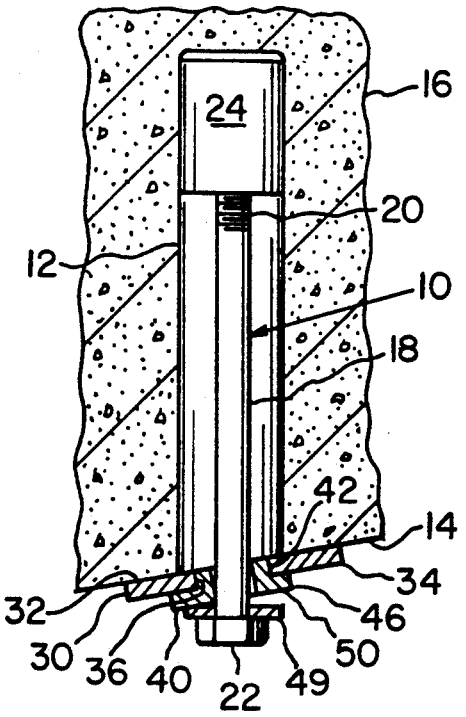
FIG. 2*a* is a side elevation al view, partially in section, showing a rock formation having a bore hole with a roof bolt assembly before engagement of the anchoring device with the mine roof bore hole wall made in accordance with the present invention.
Figure 2B:
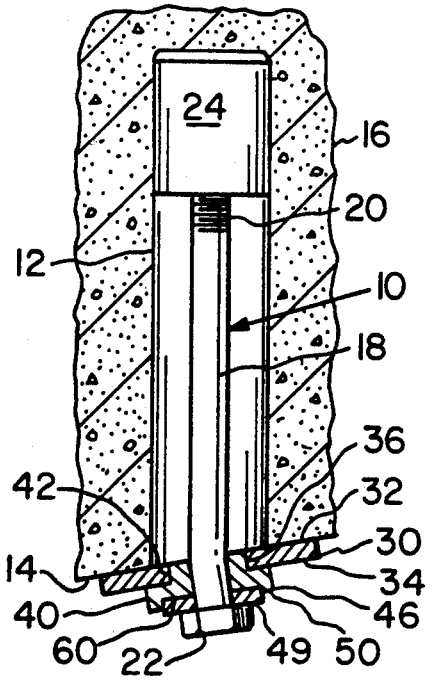
FIG. 2*b* is a side elevational view, partially in section, showing the roof bolt assembly of FIG. 2*a* after engagement of the anchoring device.

Referring to FIG. 2*a*, there is shown a roof bolt assembly 10, made in accordance with the present invention. The roof bolt assembly is positioned within a bore hole 12 which extends upwardly through a generally inclined roof surface 14 and into the rock formation 16 above the mine entry.

The roof bolt assembly 10 includes a metallic elongated bolt shaft 18 having a threaded end 20 and a head 2 positioned opposite the threaded end. The head 22 has a greater outer diameter than the shaft 18. An anchoring device 24 is threadably received on the threaded end 20 of the bolt shaft 18. The anchoring device can be a mechanical anchor such as that shown in U.S. Pat. No. 4,655,645, a bail-type anchor shown in U.S. Pat. No. 5,042,961 or any other type of anchoring device that can anchor the bolt shaft to the mine roof bore hole, which are well-known in the art.

A metallic support plate or bearing plate 30 is received on the bolt shaft 18 and rests on the bolt head 22.

Figure 3:
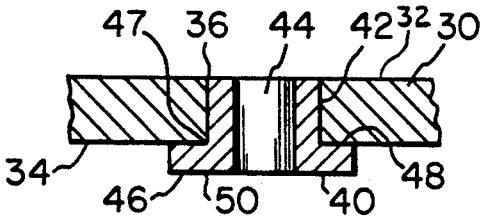
FIG. 3 is a sectional side view of a bearing plate and washer insert made in accordance with the present invention.
Figure 4:
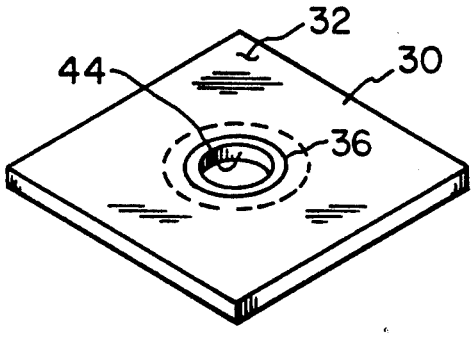
FIG. 4 is a top perspective view of a bearing plate and an insert.
Figure 5:
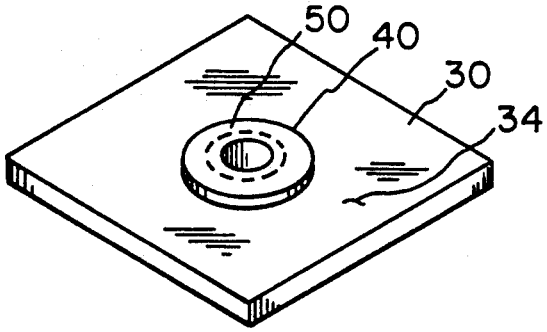
FIG. 5 is a bottom perspective view of the bearing plate and insert shown in FIG. 4.
Figure 6:
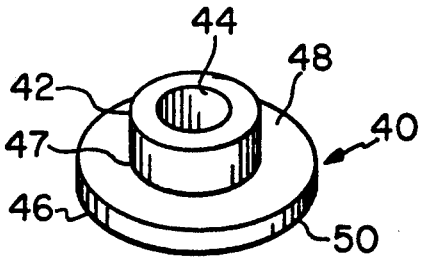
FIG. 6 is a perspective top view of the washer insert made in accordance with the present invention.

As shown in FIGS. 3-5, the bearing plate 30 has an upper surface 32 and a lower surface 34. A hole 36 passes through the bearing plate 30. The bearing plate hole 36 is larger than the bolt shaft diameter.

A washer insert 40 is received within the bearing plate hole 36. The insert 40 includes a hollow cylindrical first section 42 and an integral circular flange 46 extending outwardly and coaxial with the first section. The flange 46 attaches to a first end 47 of the first section 42. A hole 44 passes through the washer insert first section 42 and flange 46. Hole 44 has a diameter equal to or greater than the outer diameter of the bolt shaft 18. The bolt shaft 18 passes through hole 44. The mine roof bolt shaft head 22 has an outer diameter greater than the diameter of the hole 44 of the washer insert 40. An upper surface of the hollow first section 42 is substantially flush with the upper surface 32 of the bearing plate. An upper surface 48 of the flange 46 abuts against the lower surface 34 of the bearing plate 30. Preferably, the washer insert is made of a plastic, such as nylon or polypropylene, or other non-metallic material which can be deformed by the bolt head 22. The thickness of the flange is approximately 25% the thickness of the bearing plate and the height of the cylindrical first section 42 is approximately equal to the thickness of the bearing plate. The height of the first section 42 can also be greater than or less than the thickness of the bearing plate 30.

The operation of the roof bolt assembly 10 in accordance with the present invention can be explained with reference to FIGS. *2a* and *2b*. Initially, the bolt assembly, including the bolt shaft anchoring device 24, is advanced into the bore hole 12. The bolt head 22 is then pushed against a lower surface of a washer 49, which is received by the bolt shaft 20, so that an upper surface of the washer 49 pushes against a lower surface 50 of the washer insert flange 46. At least one of the washer 49 outer diameter and the bolt head 22 outer diameter are greater than the diameter of the bearing plate hole 36. Preferably, the washer is a hardened steel washer, but it can also be a friction reducing washer as described in U.S. Pat. No. 4,984,938. The washer insert flange 46 and the washer 49 are sandwiched between the bearing plate 30 and the bolt head 22. This forces the upper surface 32 of the bearing plate 30 against the roof surface 14. As can be seen in FIGS. *2a* and *2b*, when the mine roof bore hole 12 is skewed with respect to the roof surface 14, the upper surface of the washer 49 does not completely rest on the flange bottom surface 50. Upon rotation in one direction, the anchoring device 24 anchors against the mine roof bore hole walls. Continued rotation of the bolt head 22 causes the tensioning of the bolt and compression of the rock formation 16.

During rotation of the bolt in an uneven roof or skewed bore hole, the flange 46 deforms around the bolt head 22 and the washer 49, for example by wear or extrusion, so that the upper surface of the washer 49 can completely rest on the deformed bottom surface 60 of the flange 46. Further, the insert flange 46 acts as a friction reducing surface for the mine roof bolt head 22, the washer 49 and the bearing plate 30. Although the mine roof bolt 18 does deform during installation, it is not damaged or weakened by friction from rubbing against the perimeter of the bearing plate hole 36, as is the case with a mine roof bolt assembly not having a washer insert 40.

An increase of 20% more torque has been realized from a mine roof bolt arrangement made in accordance with the present invention as compared to one having a bearing plate and a friction reducing washer made in accordance with U.S. Pat. No. 4,984,938 where the bore hole was not perpendicular to the mine roof. The washer insert had the following dimensions: flange thickness $\frac{1}{8}$"; flange outer diameter $1\frac{3}{4}$"; first section inner diameter 1 5/16 "; first section outer diameter $1\frac{1}{8}$; first section height 7/16"; and was made of polypropylene.

Having described presently the preferred embodiments of this invention, it is to be understood that it may otherwise be embodied within the scope of the following claims.

I claim:

1. A washer insert for use with a bearing plate and a mine roof bolt, the bearing plate having an upper surface, a lower surface and a hole passing therethrough, and the roof bolt having a shaft with a head attached to the shaft, the outer diameter of the head being greater than the outer diameter of the shaft, said washer insert comprising:

a hollow first section having a first end and an inner diameter equal to or greater than the outer diameter of said roof bolt shaft and less than the outer diameter of the bolt head; and a flange made of plastic material attached to said first end of said first section extending outwardly from said first section and coaxial with said first section, said flange having an upper surface whereby said first section is adapted to be received within the bearing plate hole so that the upper surface of said flange abuts against the lower surface of the bearing plate, the bolt shaft passes through the hollow portion of said first section and said flange is sandwiched between the bolt head and the bearing plate, said flange bearing capable of being deformed during installation of the mine roof bolt.

2. The washer insert of claim 1 wherein said first section is a hollow cylinder and said flange is circular shaped.

3. The washer insert of claim 2 wherein said first section height is approximately equal to the bearing plate thickness.

4. The washer insert of claim 3 wherein the thickness of said flange is approximately 25% the thickness of the bearing plate.

5. The washer insert of claim 1 wherein the plastic is selected from the group consisting of nylon and polypropylene.

6. A support structure for use with a mine roof bolt having a shaft and a head attached to the shaft, the outer diameter of the head being greater than the outer diameter of the shaft, said support structure comprising:

a bearing plate having an upper surface, a lower surface and a hole passing therethrough; and a washer insert having a hollow first section with a first end and an inner diameter equal to or greater than the outer diameter of said roof bolt shaft and less than the outer diameter of the bolt head, and a flange made of plastic material attached to said first end of said first section extending outwardly from said first section and coaxial with said first section, said flange having an upper surface whereby said first section is adapted to be received within said bearing plate hole so that the upper surface of said flange abuts against the outer surface of the bearing plate, the bolt surface passes through the hollow first section and said flange is sandwiched between the bolt head and the bearing plate, said flange being capable of being deformed during installation of the mine roof bolt.

7. A mine roof anchoring arrangement comprising:

a mine roof bolt having a shaft and a head attached to said shaft, the outer diameter of said head greater than the outer diameter of the shaft;

a bearing plate having an upper surface, a lower surface and a hole passing therethrough; and a washer insert having a hollow first section with a first end and an inner diameter equal to or greater than the outer diameter of said roof bolt shaft and less than the outer diameter of the bolt head, and a flange made of plastic material attached to said first end of said first section extending outwardly from said first section and coaxial with said first section, said flange having an upper surface whereby said first section is adapted to be received within said bearing plate hole so that the upper surface of said flange abuts against the lower surface of said bearing plate, the bolt shaft passes through the hollow portion of said first section and said flange is sandwiched between the bolt head and the bearing plate, said flange being capable of being deformed during installation of the mine roof bolt.

8. The mine roof anchoring arrangement of claim 7 further comprising means for anchoring the mine roof bolt to a mine roof.

9. The mine roof anchoring arrangement of claim 8 further comprising a washer received by said bolt shaft and positioned between said bolt head and said washer insert.

10. A mine roof support system comprising:

a mine roof having a bore hole defined by a bore hole wall extending upwardly through a mine roof surface into a rock formation;

a mine roof bolt having a shaft and a head attached to said shaft, the outer diameter of said head greater than the outer diameter of said shaft;

means for securing said shaft to said mine roof bore hole wall;

a bearing plate having an upper surface, a lower surface and a hole passing therethrough; and a washer insert having a hollow first section with a first end and an inner diameter equal to or greater than the outer diameter of said roof bolt shaft and less than the outer diameter of the bolt head, and a flange made of plastic material attached to said first end of said first section extending outwardly from said first section and coaxial with said first section, said flange having an upper surface whereby said first section is adapted to be received within said bearing plate hole so that the upper surface of said flange abuts against the lower surface of said bearing plate, the bolt shaft passes through the hollow portion of said first section and said flange is sandwiched between the bolt head and the bearing plate, said flange being capable of being deformed during installation of the mine roof bolt.

11. The mine roof support system of claim 10 wherein said bore hole is skewed relative to said roof surface.

12. The washer insert of claim 7 further comprising a washer having an outer diameter sandwiched between said bolt head and said flange wherein one of the outer diameter of said bolt head and said washer is greater than the diameter of the bearing plate hole.

13. The washer insert of claim 12 wherein during installation of the bolt said flange deforms around said bolt head and said washer, so that an upper surface of said washer can completely rest on a deformed bottom surface of said flange.

* * * * *

UNITED STATES PATENT AND TRADEMARK OFFICE

CERTIFICATE OF CORRECTION

PATENT NO. : 5,147,151

DATED : September 15, 1992

INVENTOR(S) : Edward C. Hipkins, Jr.

It is certified that error appears in the above-identified patent and that said Letters Patent is hereby corrected as shown below:

Column 2 Line 30 "elevation al" should read --elevational--.

Column 2 Line 58 "2" should read --22--.

Column 4 Line 7 "1 1/8;" should read --1 1/8";--.

Claim 1 Line 36 Column 4 "bearing" should read --being--.

Claim 6 Line 67 Column 4 "surface" should read --shaft--.

Signed and Sealed this

Twenty-first Day of September, 1993

Bruce Lehman

*Attest:*

BRUCE LEHMAN

*Attesting Officer*

*Commissioner of Patents and Trademarks*